United States Patent [19]

Ihlenburg

[11] Patent Number: 4,914,838

[45] Date of Patent: Apr. 10, 1990

[54] SPORT SHOE WITH METATARSAL CRADLE AND DRAG TOE

[75] Inventor: Frederick H. Ihlenburg, Lake Oswego, Oreg.

[73] Assignee: Ringor Inc., Lake Oswego, Oreg.

[21] Appl. No.: 233,469

[22] Filed: Aug. 18, 1988

[51] Int. Cl.[4] ..... A43B 13/18; A43B 5/00

[52] U.S. Cl. ..... 36/114; 36/102; 36/128; 36/129

[58] Field of Search ..... 36/25 R, 30 R, 67 R, 36/59 R, 77 R, 77 M, 78, 102, 103, 114, 115, 126, 128, 129, 134, 59 A, 59 C, 28, 29

[56] References Cited

U.S. PATENT DOCUMENTS

| | | | |
|---|---|---|---|
| 6,421 | 4/1875 | Prusha . | |
| 6,438 | 5/1875 | Hussey . | |
| 170,016 | 11/1875 | Rice . | |
| 278,759 | 5/1885 | Norton . | |
| 278,760 | 5/1885 | Norton . | |
| 1,370,797 | 3/1921 | Egerton . | |
| 1,923,365 | 8/1933 | Gaines | 36/126 |
| 2,040,186 | 5/1936 | Riddell . | |
| 3,028,689 | 4/1962 | Dassler . | |
| 3,127,687 | 4/1964 | Hollister . | |
| 4,155,180 | 5/1979 | Phillips | 36/103 X |
| 4,392,312 | 7/1983 | Crowley . | |
| 4,393,604 | 6/1983 | Crowley . | |
| 4,398,357 | 8/1983 | Batra | 36/129 X |
| 4,454,662 | 6/1984 | Stubblefield . | |
| 4,507,879 | 4/1985 | Dassler | 36/102 |
| 4,562,652 | 1/1986 | Hensler | 36/102 |
| 4,574,498 | 3/1986 | Norton . | |
| 4,597,199 | 7/1986 | Hong . | |
| 4,599,724 | 12/1985 | Norton . | |
| 4,667,423 | 5/1987 | Autry | 36/102 |
| 4,689,901 | 9/1987 | Ihlenberg | 36/114 X |

FOREIGN PATENT DOCUMENTS

| | | | |
|---|---|---|---|
| 407499 | 3/1934 | United Kingdom | 36/127 |

*Primary Examiner*—Donald Watkins

*Attorney, Agent, or Firm*—Cushman, Darby & Cushman

[57] ABSTRACT

A sport shoe is provided having a circular cleat array disposed about but not directly beneath the metatarsal joint of the great toe. The shoe sole also includes a flex area in the region of the metatarsal joints. This combination permits flexure of and cradles the metatarsal joints on impact. Furthermore, the sport shoe preferably includes a toe drag element defined forwardly and upwardly of the metatarsal cradle and on the interior edge as a lip extending onto and over a portion of the shoe upper. The toe drag element protects the material of the shoe from the effects of toe drag while minimizing any reduction in flexibility of the shoe.

11 Claims, 3 Drawing Sheets

60
46
24
28
40
26
22
32
48
28
56
60
24
46

SPORT SHOE WITH METATARSAL CRADLE AND DRAG TOE

BACKGROUND OF THE INVENTION

1. Field of the Invention

The present invention relates to a sport shoe and, in particular, to a sport shoe having a cradle for the metatarsal joint area adjacent the great toe of the foot and having a drag toe structure for protecting the shoe from wear due to toe dragging.

2. Description of the Related Art

Cleated or spiked sport shoes are well known and come in a variety of designs which facilitate anchoring of the shoe when running or playing sports and mobility for the wearer through the particular placement of the cleat or spike elements. A variety of spike configurations have been developed bearing in mind the particular sport for which the shoe is used and the particular surface upon which the sport is played. A number of the cleat or spike configurations provided to date include the presence of a cleat directly under the metatarsal joint of the great toe of the foot or a multiplicity of cleats that extend across the metatarsal area. A cleat has been placed in this region of the foot because it is the theoretical center of gravity of the weight carried by that foot of the player. Accordingly, it has been believed that placing the spike in this locality will maximize the anchoring of the spike of cleat and hence provide the greatest utility of such cleats and facilitate the use of the shoe on dirt or turf.

Despite the theoretical advantages of providing a cleat beneath the metatarsal joint of the great toe, such a disposition of cleats is extremely uncomfortable for the wearer. Indeed, because the normal running impact sequence of the foot is a rolling motion, from a first contact with the ground at the outer portion of the heel to an impact of the weight of the body in the region of the inner portion of the ball of the foot, the weight of the player comes down hard upon the metatarsal joint of the great toe. Continual driving of such a metatarsal spike into the ground in this manner causes bone bruising and general soreness. To avoid this discomfort, players will lighten their stride when they strike a hard spot or stone which results in a loss of speed and stability.

It would, therefore, be desirable to provide a cleat configuration as well as a sole structure for a shoe which avoids driving of the spikes into the ground by the bones of the foot and protects metatarsal joints to maximize the comfort of the player so that maximum speed and stability can be realized.

A further problem associated with active sports, particularly those in which cleated or spiked shoes are worn and player collisons are common, is "turf toe." Turf toe occurs when the player has planted the shoe firmly in the ground to obtain traction and is then knocked or falls forward while the toe of the shoe remains planted. When the shoe is planted in this manner, the great toe is hyperflexed at the metatarsal joint which results in extreme pain, damaged ligaments, and, possibly, long term injury.

It would, therefore, be desirable to provide a sport shoe sole which minimizes the likelihood of hyperflexure of the great toe or "turf toe" while still maximizing shoe flexibility for player comfort.

An even further problem encountered by wearers of sport shoes and particularly those who play sports requiring the throwing of objects at high velocity is that the throwers typically use their body weight in tossing the ball or the like. When body weight is used in this manner, one foot is first planted forwardly of the player and then, as the object is thrown, the body moves forward onto the forward foot. During this motion and following the release of the ball, then, the trailing foot is dragged forward. When the trailing foot is dragged in this manner, the inner forward edge of the shoe is dragged against the turf or dirt. Furthermore, this dragging of the shoe often occurs with a great deal of force as a reaction to the forward thrust of the throwing arm. In fact, the dragging of the shoe is typically with such force that a significant amount of damage occurs to the forward portion of the shoe material or upper. Thus, through the course of a single game the shoe can be rendered worthless as it will no longer have its original structural integrity and will no longer protect the wearer's foot.

There have been attempts to prevent the destruction of shoes due to toe dragging. For example, it is known to apply a polymer-like material to the top and forward portions of the shoe to reinforce the upper and thus resist wear from toe dragging. However, applying such a coating to the shoe covers a large portion of the shoe and thus disadvantageously reduces the flexibility of the entire shoe. The reduction in flexibility in turn reduces the mobility and comfort of the wearer. Furthermore, applying a separate polymer coating in this manner has heretofore been a separate process from the shoe manufacturing process and thus requires that the consumer locate an individual who can reinforce his shoe in this manner. This disadvantageously requires the expenditure of time and money by the consumer and the resultant product is, as noted above, less than satisfactory.

SUMMARY OF THE INVENTION

It is an object of the present invention to provide a spiked sport shoe which has a spike or cleat array configuration and sole structure which avoids metatarsal bone bruising.

It is a further object of the present invention to provide a sole structure which reduces the likelihood of hyperflexure of the metatarsal joint of the great toe and thus minimizes the likelihood that a player will suffer from "turf toe."

It is yet another object of the present invention to provide a sport shoe sole which minimizes toe drag wear without requiring the application of a polymer coating to the shoe upper.

These and other objects are achieved in accordance with the present invention by providing a circular cleat array wherein no cleats or spikes are disposed below the metatarsal joint of the great toe and wherein the shoe sole is formed in the region of the metatarsal joints so as to permit flexure of the same and thus cradle the metatarsal joints on impact. Furthermore, in accordance with a most preferred embodiment of the present invention, the sole configuration defining the metatarsal cradle includes alternatively increased thickness portions and reduce thickness portions on both the interior and exterior surfaces of the sole, such that flexure of the metatarsal cradle of greater than a predetermined amount results in abutting contact of the increased thickness portions of the cradle. This abutment prevents flexure of the shoe beyond a desired degree and, accordingly, minimizes the likelihood of hyperflexure of the great toe while allowing a cradling of this portion of the foot.

Furthermore, in a most preferred embodiment the present invention provides a sport shoe sole having a toe drag element defined forwardly and upwardly of the metatarsal cradle portion as a lip extending onto the upper of the shoe. The toe drag elements protects the material of the shoe from the effects of toe drag and yet is minimal in size so as to minimize the reduction in flexibility of the shoe sole to ensure the cradling effects of the metatarsal cradle while effectively increasing the durability and life span of the shoe.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings all of which form a part off this specification, wherein like reference numerals designate corresponding parts in the various figures.

DETAILED DESCRIPTION OF THE PRESENTLY PREFERRED EXEMPLARY EMBODIMENT

Figure 1:
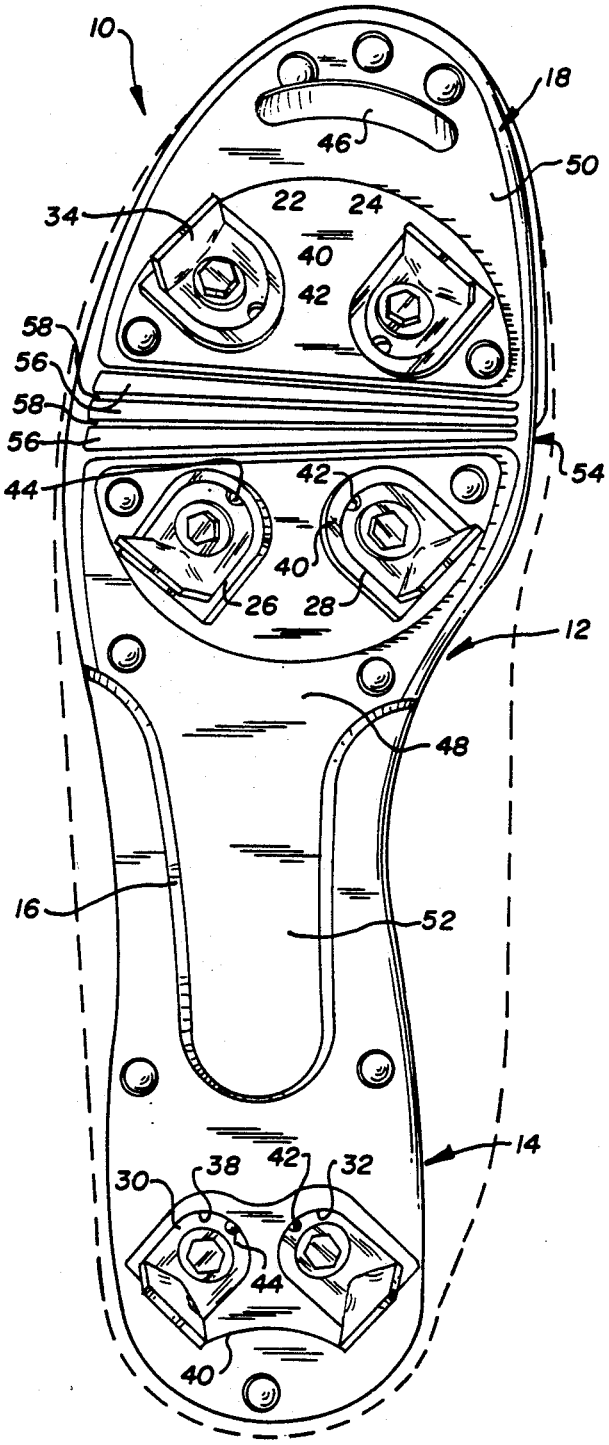
FIG. 1 is a bottom plan view of a sport shoe sole formed in accordance with the present invention.

Referring to FIG. 1, the sole of the sport shoe formed in accordance with the present invention, generally indicated at 10, has a main sole member 12 which includes an enlarged thickness portion 14 at the rearward end of the shoe which surrounds a thinner central area 16, and a reduced thickness portion 18 at the forward end of the shoe. The forward end 18 also has an increased width for accommodating the ball of the foot and the toes. The rearward end 14 of the shoe sole has an increased thickness to provide the rigidity and support required for the heel of the athlete. Furthermore, it has been found that where the heel of the sport shoe is not raised, the Achilles tendon is stretched which can increase the potential for shin splints and shoreness in the knees, legs and ankles. Thus, providing a raised heel reduces leg fatigue, muscle cramps and shin splints, in addition to ensuring structural integrity of the shoe under long term wear.

Figure 2:
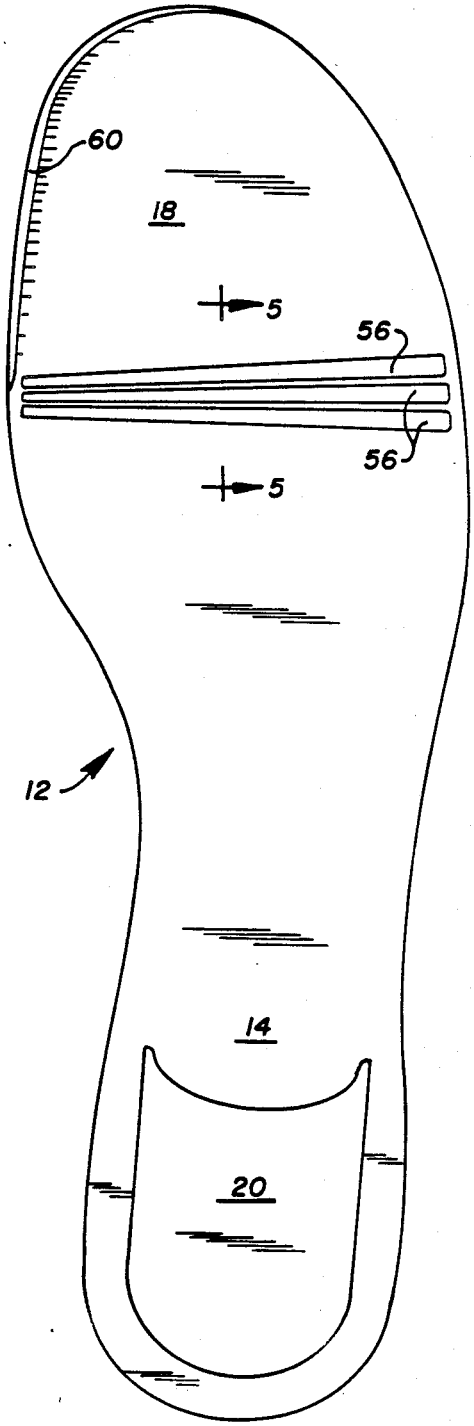
FIG. 2 is a top plan view of the sole of the sport shoe of FIG. 1.

Furthermore, as shown in FIG. 2, a cushioning wedge 20 made of, for example, E.V.A. is preferably embedded within the raised heel portion of the main sole member. Providing such a cushioning system softens heel impact without modifying the profile of the shoe which, as noted above, maximizes leg comfort.

Figures 3, 4:
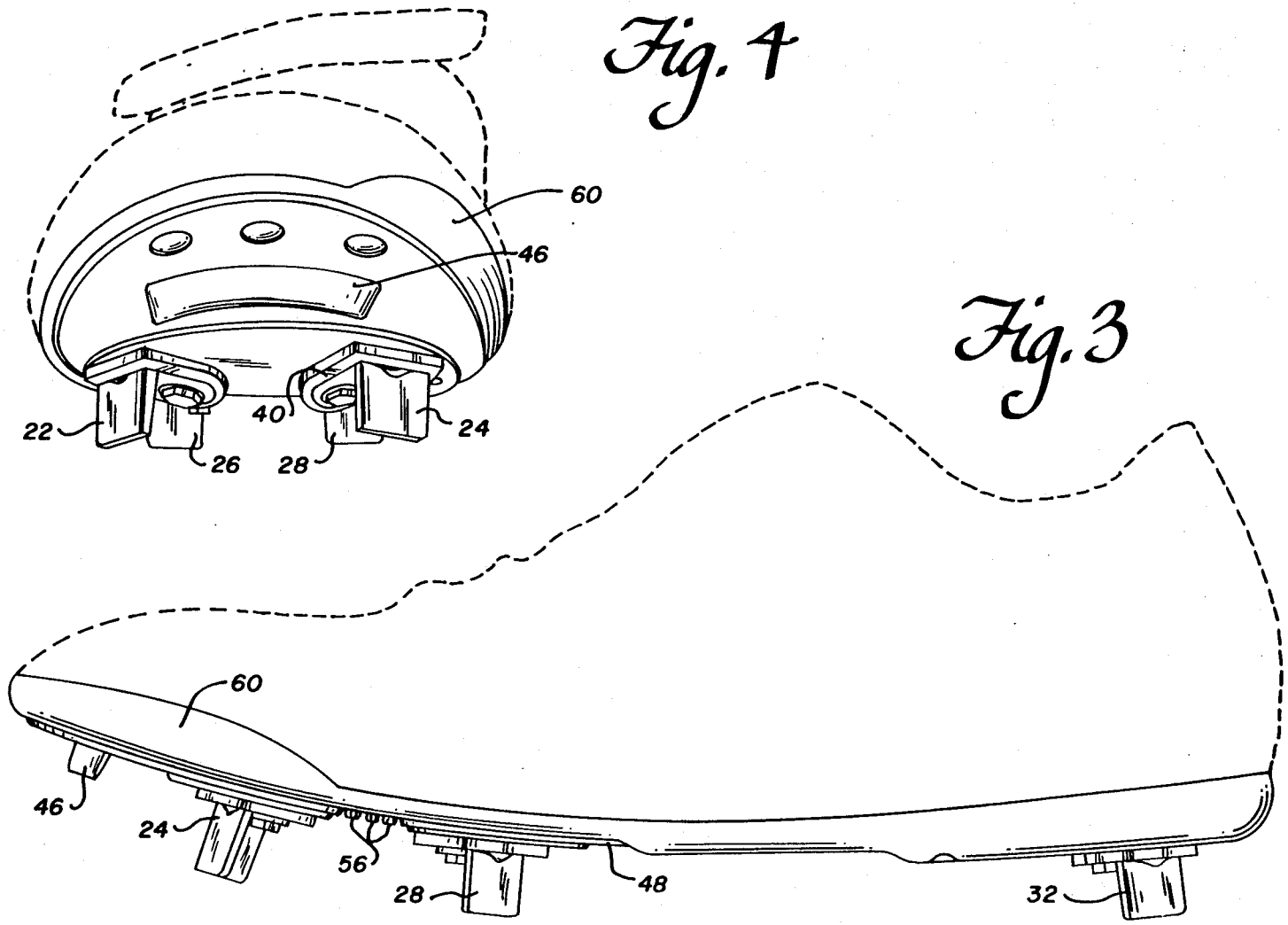
FIG. 3 is a side elevational view of the inner face of a sport shoe sole formed in accordance with the present invention.
FIG. 4 is a front view of the sport shoe formed in accordance with the present invention.
Figure 6:
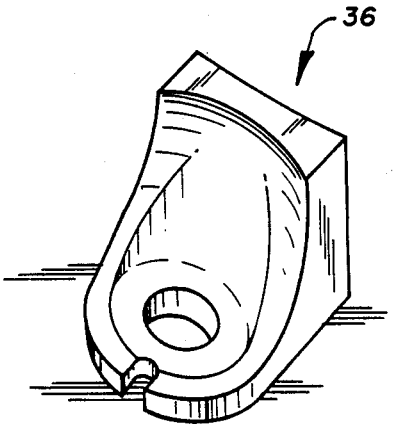
FIG. 6 is a perspective view of an alternate cleat provided in accordance with the invention.

A number of cleats or spikes 22–32 are removably coupled to the sole 12 of the shoe. In accordance with the preferred embodiment of the present invention the spikes are removably mounted to the sole of the shoe so that metal spikes, for example, can be interchanged with polymer spikes depending upon the sport being played and turf conditions. Metal spikes provided in accordance with the present invention, and as illustrated in FIGS. 2, 3 and 4, are substantially L-shaped with a planar upstanding spike portion as shown at 34 in FIG. 1. The metal spikes are preferably interchangeable with polymer spikes 36 which are also substantially L-shaped but wherein the upstanding spike portion is a double concave design to effectively cut into the ground, as shown in FIG. 6. In the illustrated embodiment, each of the spikes, whether metal or polymeric, are mounted to locking indentations 38 defined in the material of the sole of the shoe. This ensures that the spikes are properly secured to the sole of the shoe and in a proper orientation relative to the remaining spikes. In the illustrated embodiment, the locking indentations are defined in raised portions 40 on the sole of the shoe to minimize the overall thickness of the shoe sole and hence to maximize the flexibility of the shoe and lightweight characteristics of the same while mnimizing discomfort from cleat driving. Raised portions 40 further include a key or projection 42 that extends into the locking indentation. This key 42 will mate with a slot 44 cut or formed in each spike to assure proper alignment therebetween.

As can be seen, two spikes 30 and 32 are preferably mounted to the raised heel portion 14 of the shoe. These two cleats 30, 32 will provide all the necessary traction without providing an arrangement that will undesirably clog with dirt, as has been heretofore experienced with closed heel spike configurations. The spikes mounted to the forward end of the shoe, 22–28, on the other hand, are preferably disposed in a substantially circular array. This rotational cleat design gives faster, easier turn response and reduces the potential for knee and ankle injury. Further, the configuration of the cleats enables the major spikes to be leveraged into the ground thereby increasing traction especially on hard dirt where driven spikes only dent the surface.

The cleat configuration of the sport shoe formed in accordance with the present invention further includes a low profile, arcuate, traction bar 46 mounted forwardly of the circular array of cleats. The traction bar 46 reduces the potential for tripping during pushoff due to its low profile and yet ensures the traction required for a maximum pushoff force.

Figure 5:
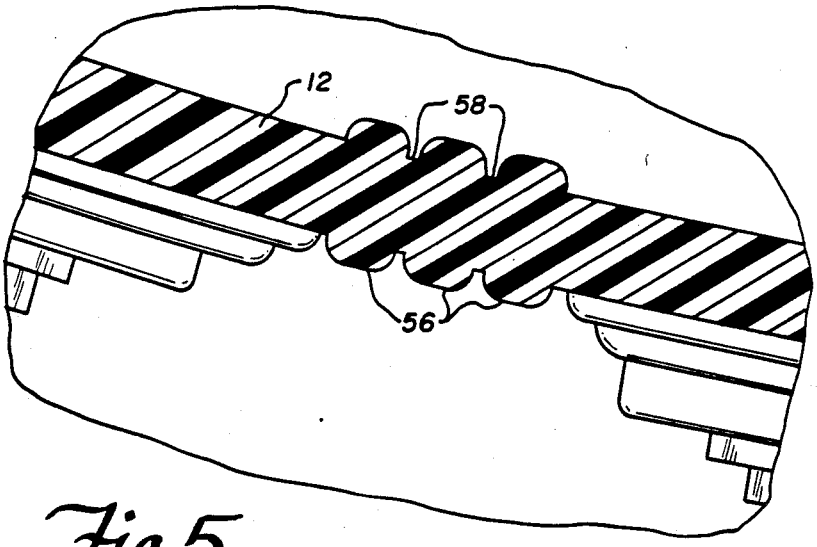
FIG. 5 is a cross-sectional view, partly broken away for clarity, of a metatarsal cradle formed in accordance with a preferred embodiment of the present invention.

As can be further seen in FIGS. 1 and 5, the main sole member 12 is overlaid in the forward portion of the shoe with a second, two part bottom sole material 48, 50 which may be of the same or a different material than the main sole member 12. Preferably the two-part bottom side material or base is slightly more rigid for durability and firm retention of the spike elements. The two part base includes a rearward portion 48 having a tongue 2 interlocking with the slot 16 defined in the raised heel 14, and accommodates spikes 26 and 28 of the circular array on the forward portion of the shoe. The second portion 50 of the bottom sole accommodates the other two spikes 22, 24 of the circular array. Between the first and second base sole members the main sole member 12 is exposed and it is in this region that the metatarsal cradle shown generally at 54 is formed in accordance with the present invention.

More particularly, and referring specifically to FIG. 5, the forward portion 18 of the main sole member 12 of the shoe in the region of the metatarsal joints defines a plurality of ridges 56 both on the interior surface and the exterior surface of the sole. The ridges on the bottom portion of the sole have a height so as to be coincident with the height of the base portion 48, 50 of the sole. Gaps 50 are, accordingly, formed between adjacent ridges 56 and define grooves relative to the bottom of the surface of the shoe. The strength of the main sole member is not reduced as the thickness of the main sole member itself is not reduced. Further, the ridges 56 defined on the interior surface of the sole constitute regions of increased sole thickness on that surface, as discussed more fully below.

Because the gaps 58 between adjacent ridges 56 defined on the bottom surface of the main sole member 12 constitute grooves of reduced thickness relative to the base of the shoe, the sole of the grooves and thus defines a cradle 54 for the metatarsal joints. As the runner impacts the ground on the ball of his foot, then, the shoe will give in the region of the grooves and will both flex and cradle the metatarsal joints, minimizing the force of impact for the metatarsal bones. Thus, the wearer's comfort is increased and the likelihood of bone bruises is reduced.

As the shoe is flexed in this manner, however, on the interior surface of the sole, the adjacent raised portions 56 move towards one another. At a given point of flexure of the shoe the raised portions on the interior surface of the sole will contact one another and resist further flexure of the sole, as an increased sole thickness would reduce such flexure. Thus, flexing of the shoe beyond the predetermined flexure amount is resisted by the sole configuration of the present invention. Accordingly, the likelihood that the athlete will suffer hyperflexure of the great toe metatarsal joint or "turf toe" is minimized even though the flexure of this portion of the shoe has been increased by the provision of the grooved metatarsal cradle 54. As is apparent, then, the ridged and grooved configuration of the main sole member of the present invention minimizes the likelihood of metatarsal bruising due to driving spikes and increases comfort of the wearer and, further, minimizes the likelihood of hyperflexure of the great toe metatarsal joint.

The sport shoe sole formed in accordance with the present invention further includes a drag toe element 60 which can be seen most clearly in FIGS. 3 and 4. The drag toe element 60 is formed integrally with the main sole member 12 of the shoe and extends forwardly and upwardly from the base of the shoe with its rearward end beginning at a point spaced forwardly of the metatarsal cradle 54. The front of the drag toe element 60 extends to a point in front of the great toe. Thus, the drag toe element terminates approximately one-third of the way across the front end of the shoe. Further, the drag toe element 60 extends upwardly from the main sole member 12 to cover the shoe upper adjacent the side of the great toe. The particular extent of the drag toe element will, of course, depend upon the size of the shoe, the sport for which it is designed and the desires of the consumer. In addition, athletes who experience drag toe wear higher on the front of the shoe could be provided with the option of a shoe having a higher drag toe element while others could select a shoe having a minimal toe drag element.

Thus, the optimum height of the drag toe element relative to the top of the shoe sole can be varied in dependence upon the actual wear of the shoe experienced and is clearly not limited to the particular dimensions shown in FIGS. 3 and 4. However, it has been found the lip of the height as shown in the drawing FIGURES is sufficient to minimize the wear of the shoe from drag toe and thus minimizes the likelihood of the separation of the sole from the upper of the shoe while maximizing the durability of the upper as well as the comfort of the wearer.

Because the drag toe element 60 formed in accordance with the present invention is a part of the sole 12 of the shoe and thus is formed when the shoe was formed, the athlete need not modify the sport shoe following purchase by, for example, applying a polymer coating to the forward end of the shoe. Furthermore, because the drag toe element terminates rearwardly in the region of the metatarsal cradle, the reinforcement provided by the drag toe element does not reduce the flexibility of the shoe sole and thus does not reduce the efficacy of the metatarsal cradle.

While the invention has been described in connection with what is presently considered to be the most practical and preferred embodiment it is to be understood that the invention is not limited to the disclosed embodiment, but, on the contrary, it is intended to cover various modifications and equivalent arrangements included within the spirit and scope of the appended claims.

What is claimed is:

1. A sole for a sport shoe comprising:

a molded main sole member having a longitudinal axis, a rearward heel portion and a forward portion for underlying the ball of the foot and the toes including a curved leading edge;

a plurality of cleat receiving elements formed in a bottom surface of said sole in a shaped array defined on said forward portion of said main sole member, said elements being disposed so as to be spaced from a portion of said main sole member coincident with the metatarsal joints of the foot of the wearer;

said portion of said main sole member coincident with the metatarsal joints including a plurality of ribs extending substantially transversely relative to the axis of said sole said ribs being provided at least on a bottom surface of said main sole member so that said portion of said main sole member defines a cradle for the metatarsal joints of the wearer's foot; and an upwardly extending flange extending about a portion of the periphery of the sole on the instep side thereof from a location adjacent said ribs to a point about one third around the leading edge.

2. A sport shoe sale as in claim 1, further including a two-part bottom sole material overlayed on said bottom surface of said forward portion of said main sole member, said shaped array being defined in said two-part bottom sole material, said two-part bottom sole material being mounted to said main sole member so as to be spaced apart to define a gap therebetween, said ribs of said main sole member being disposed in said gap.

3. A sport shoe sole as in claim 1, wherein said plurality of cleat receiving elements includes first and second cleat receiving elements mounted to a bottom surface of said rearward heel portion of said main sole member.

4. A sport shoe sole as in claim 1, further including an arc-shaped traction bar element mounted to the bottom of the shoe forwardly of said shaped array of cleat receiving elements.

5. A sport shoe sole as in claim 1, wherein said shaped array is a circular array.

6. A sport shoe sole as in claim 1, further including substantially L-shaped metal cleat elements mounted to at least some of said cleat receiving elements.

7. A sport shoe sole as in claim 1, further including substantially L-shaped polymeric cleat elements mounted to at least some of said cleat receiving elements.

8. A sport shoe sole as in claim 1, wherein said ribs are provided on both a bottom surface and a top surface of said main sole member.

9. A sole for a sport shoe comprising:

a molded main sole member having a longitudinal axis, a rearward heel portion and a forward portion for underlying the ball of the foot and the toes including a curved leading edge;

a plurality of cleat receiving elements formed in a bottom surface of said sole in a shaped array defined on said forward portion of said main sole member, said elements being disposed so as to be spaced from a portion of said main sole member coincident with the metatarsal joints of the foot of the said portion of said main sole member coincidental with the metatarsal joints including a plurality of ribs extending substantially transversely relative to the axis of said sole, said ribs being provided on both a bottom surface and an upper surface of said main sole member and extending outwardly therefrom so that said portion of said main sole member defines a cradle for the metatarsal joints of the wearer's foot.

10. A sole for a sport shoe comprising:

a molded main sole member having a longitudinal axis, a rearward heel portion and a forward portion for underlying the ball of the foot and the toes including a curved leading edge; and an upwardly extending flange extending about a portion of the periphery of the sole on the instep side thereof from a location adjacent a portion of said main sole member coincident with the metatarsal joints of the foot of the wearer to a point about one third around the leading edge.

11. A sport shoe sole as in claim 10, further including a plurality of cleat receiving elements formed in a bottom surface of said sole in a shaped array defined on said forward portion of said main sole member, said elements being disposed so as to be spaced from a portion of said main sole member coincident with the metatarsal joints of the foot of the wearer.

* * * * *